US009316991B2

(12) United States Patent
Takagi

(10) Patent No.: US 9,316,991 B2
(45) Date of Patent: Apr. 19, 2016

(54) DEVELOPER CARTRIDGE

(71) Applicant: Takeyuki Takagi, Nagoya (JP)

(72) Inventor: Takeyuki Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/928,465

(22) Filed: Jun. 27, 2013

(65) Prior Publication Data

US 2013/0287425 A1 Oct. 31, 2013

Related U.S. Application Data

(63) Continuation-in-part of application No. PCT/JP2011/080014, filed on Dec. 26, 2011.

(30) Foreign Application Priority Data

Dec. 27, 2010 (JP) ..... 2010-290486

(51) Int. Cl.
*G03G 21/18* (2006.01)
*G03G 15/00* (2006.01)
*G03G 15/08* (2006.01)

(52) U.S. Cl.
CPC ..... *G03G 15/80* (2013.01); *G03G 15/0806* (2013.01); *G03G 15/0808* (2013.01); *G03G 15/0832* (2013.01); *G03G 15/0865* (2013.01); *G03G 15/0896* (2013.01); *G03G 21/1867* (2013.01); *G03G 21/1871* (2013.01); *G03G 2221/163* (2013.01); *G03G 2221/166* (2013.01); *G03G 2221/1651* (2013.01);

(Continued)

(58) Field of Classification Search
CPC ..... G03G 21/18
USPC ..... 399/90
See application file for complete search history.

(56) References Cited

U.S. PATENT DOCUMENTS 5,614,996 A * 3/1997 Tanda ..... 399/120
7,236,726 B2 * 6/2007 Mori et al. ..... 399/252

(Continued)

FOREIGN PATENT DOCUMENTS

JP 2000-010389 * 1/2000 ..... G03G 15/08
JP 2000-010389 A 1/2000

(Continued)

OTHER PUBLICATIONS

International Preliminary Report on Patentability issued in corresponding International Application No. PCT/JP2011/080014 mailed Jul. 11, 2013.

(Continued)

*Primary Examiner* — Clayton E Laballe
*Assistant Examiner* — Kevin Butler
(74) *Attorney, Agent, or Firm* — Banner & Witcoff, Ltd.

(57) ABSTRACT

A developer cartridge includes a case, a developer carrying member, a developer supplying member, a cap, an electrode, and a fixing member. The case has a first side wall formed with a toner fill-hole and a second side wall facing the first side wall in a particular direction. The cap is configured to seal the toner fill-hole. The electrode is configured to supply a bias voltage to at least one of the developer carrying member and the developer supplying member. The fixing member is configured to fix the electrode to the cap such that the electrode is disposed in superposed relation to the cap in the particular direction.

9 Claims, 15 Drawing Sheets

(52) U.S. Cl.
CPC . *G03G 2221/1657* (2013.01); *G03G 2221/183* (2013.01); *G03G 2221/1815* (2013.01)

(56) References Cited

U.S. PATENT DOCUMENTS

| | | | | |
|---|---|---|---|---|
| 7,561,817 | B2 | 7/2009 | Sato | |
| RE42,885 | E | 11/2011 | Yamaguchi et al. | |
| 2005/0190997 | A1 | 9/2005 | Yamguchi et al. | |
| 2006/0171737 | A1 | 8/2006 | Nishimura et al. | |
| 2006/0171743 | A1* | 8/2006 | Mori et al. | 399/252 |
| 2006/0193652 | A1 | 8/2006 | Sato | |
| 2007/0009281 | A1 | 1/2007 | Sato et al. | |
| 2007/0009282 | A1 | 1/2007 | Sato et al. | |
| 2008/0298838 | A1* | 12/2008 | Sato et al. | 399/119 |
| 2010/0296833 | A1 | 11/2010 | Sato et al. | |
| 2011/0299875 | A1 | 12/2011 | Sato et al. | |
| 2012/0251187 | A1 | 10/2012 | Sato et al. | |
| 2013/0287425 | A1* | 10/2013 | Takagi | 399/90 |

FOREIGN PATENT DOCUMENTS

| | | | | |
|---|---|---|---|---|
| JP | 2005-282677 | A | 10/2005 | |
| JP | 2006-235472 | * | 9/2006 | G03G 15/08 |
| JP | 2006-235472 | A | 9/2006 | |
| JP | 2006-276690 | * | 10/2006 | G03G 15/08 |
| JP | 2006-276690 | A | 10/2006 | |
| JP | 2007-102152 | * | 4/2007 | G03G 15/08 |
| JP | 2007-102152 | A | 4/2007 | |
| JP | 2008-191401 | A | 8/2008 | |

OTHER PUBLICATIONS

Office Action issued in corresponding Japanese Patent Application No. 2010-290486 mailed Nov. 13, 2012.

Office Action issued in corresponding Japanese Patent Application No. 2010-290486 mailed Feb. 5, 2013.

* cited by examiner

DEVELOPER CARTRIDGE

CROSS REFERENCE TO RELATED APPLICATION

This application is a continuation in part of International Application No. PCT/JP2011/080014 filed Dec. 26, 2011 which claims priority from Japanese Patent Application No. 2010-290486 filed Dec. 27, 2010. The entire content of the international application and the priority application are incorporated herein by reference.

TECHNICAL FIELD

The present invention relates to a developer cartridge provided in an image-forming device, such as a laser printer.

BACKGROUND

One conventional image-forming device has a photosensitive drum cartridge detachably mounted in the device body, and a developer cartridge that mounts on the photosensitive drum cartridge. The photosensitive drum cartridge is provided with a photosensitive drum, and the developer cartridge is provided with a developing roller and a supply roller.

A hopper is formed in the inside of the developer cartridge for accommodating toner. The supply roller in the developer cartridge supplies toner from the hopper onto the developing roller. As the photosensitive drum and the developing roller rotate, the developing roller supplies toner to an electrostatic latent image formed on the surface of the photosensitive drum, developing the latent image into a toner image. The toner image is transferred onto paper to complete the image-forming operation.

In order to implement this developing operation, the image-forming device must apply bias voltages to the developing roller and the supply roller. For this purpose, the developer cartridge is provided with a developing electrode and a supply electrode. The developing electrode and supply electrode are provided on a side surface of the developer cartridge and are electrically connected to the developing roller and supply roller, respectively. When the developer cartridge is mounted in the device body together with the photosensitive drum cartridge, the developing electrode and supply electrode are connected to electrodes provided in the device body, enabling the image-forming device to apply bias voltages to the developing electrode and supply electrode.

SUMMARY OF THE INVENTION

Developer cartridges have been made smaller and smaller in recent years, but this reduction in size brings with it limitations in how members can be provided on the side surface of the developer cartridge. For example, in addition to a developing electrode and supply electrode, a cap is also provided on one side surface of the developer cartridge for sealing a hole through which the hopper is filled with toner. Further, reducing the size of the developer cartridge results in a smaller hopper, requiring the cap to be positioned closer to the developing roller and supply roller. This gives rise to difficulties in arranging the developing electrode and supply electrode next to the cap.

Further, if the developing electrode or supply electrode is arranged to overlap the cap, the positioning of the electrode overlapping the cap becomes unstable, potentially leading to an unreliable connection between the electrode and the corresponding electrode in the device body.

In view of the foregoing, it is an object of the present invention to provide a developer cartridge having electrodes whose positions can be maintained with stability.

This and other object of the present invention will be attained by a developer cartridge including: a case, a developer carrying member, a developer supplying member, a cap, an electrode and a fixing member. The case includes a first side wall formed with a toner fill-hole and a second side wall facing in a particular direction to the first side wall, and the case is configured to accommodate a developing agent therein. The developer carrying member is supported to the first side wall and the second side wall and rotatable about a rotation axis extending in the particular direction, and the developer carrying member is configured to carry the developing agent. The developer supplying member is supported to the first side wall and the second side wall and rotatable about a rotary axis extending in the particular direction, and the developer supplying member is configured to supply the developing agent onto the developer carrying member. The cap is configured to seal the toner fill-hole. The electrode is configured to supply a bias voltage to at least one of the developer carrying member and the developer supplying member. The fixing member is configured to fix the electrode to the cap such that the electrode is disposed in superposed relation to the cap in the particular direction upon fixing with the fixing member.

DESCRIPTION OF THE PREFERRED EMBODIMENTS

Next, a preferred embodiment of the present invention will be described in detail while referring to the accompanying drawings.

1. Laser Printer

Figure 1:
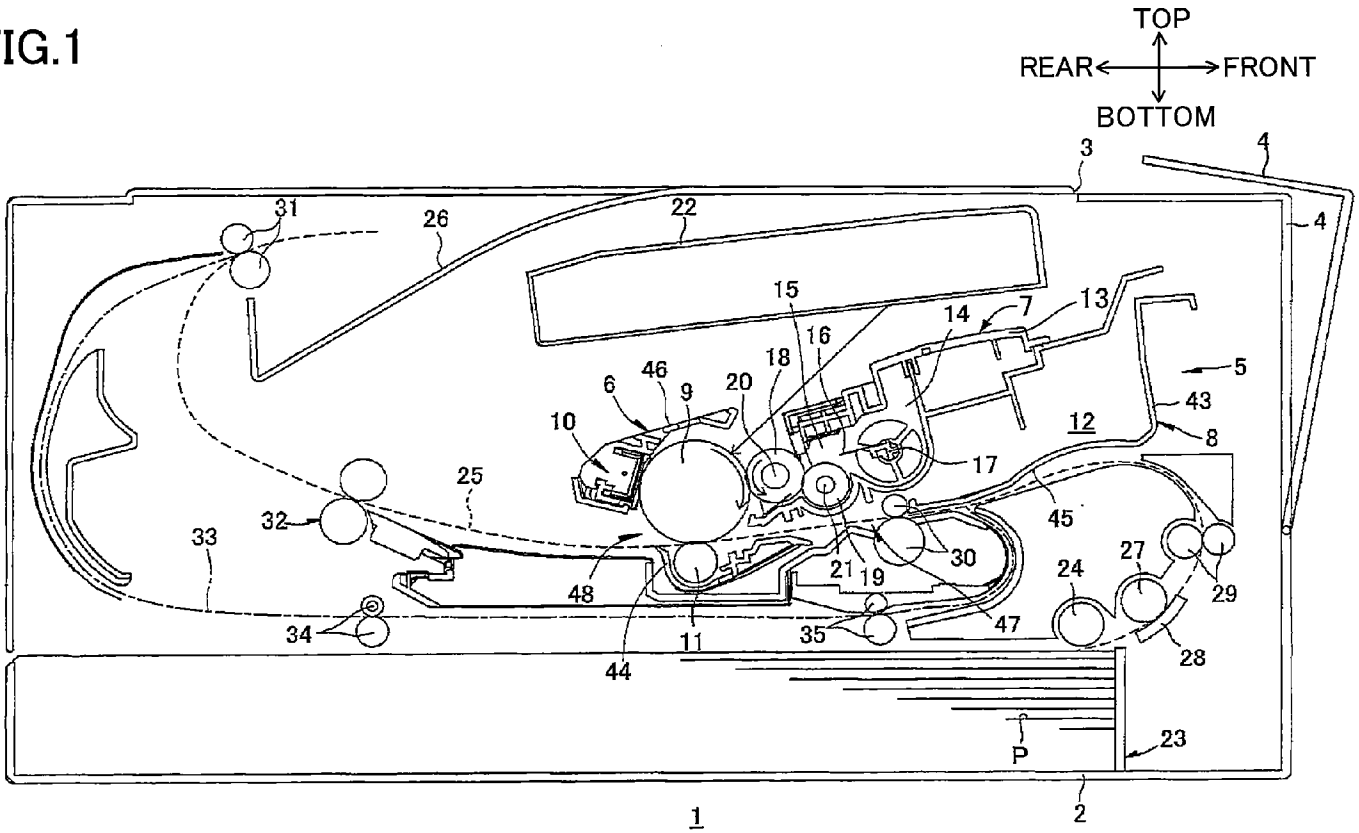
FIG. 1 is a schematic cross-sectional side view of a laser printer including a process cartridge provided with a developer cartridge according to a first embodiment of the present invention.

FIG. 1 shows a laser printer 1 provided with a main casing 2. A cartridge-mounting opening 3 is formed in a side wall constituting the front surface of the main casing 2. A front cover 4 is provided over the cartridge-mounting opening 3 for opening and closing the same.

The side of the laser printer 1 normally faced by the user is defined as the front side in a front-rear direction. When a laser printer 1 is placed on a flat surface, the direction orthogonal to this flat surface is the vertical direction, and the left and right sides of the laser printer 1 are defined based on the perspective of the user facing the front of the laser printer 1.

A process cartridge 5 is mounted inside the main casing 2 at a position slightly forward of center. The process cartridge 5 is mounted in the main casing 2 and removed from the main casing 2 through the cartridge-mounting opening 3 while the front cover 4 is in its open state.

The process cartridge 5 is configured of a drum cartridge 6, and a developer cartridge 7 that is detachably mounted on the drum cartridge 6.

The drum cartridge 6 includes a drum frame 8. A photosensitive drum 9 is rotatably held in the rear end portion of the drum frame 8. The drum frame 8 also retains a charger 10, and a transfer roller 11. The charger 10 is disposed on the rear side of the photosensitive drum 9 and the transfer roller 11 is disposed beneath the photosensitive drum 9.

The portion of the drum frame 8 forward of the photosensitive drum 9 constitutes a cartridge-mounting unit 12. The developer cartridge 7 is mounted in the cartridge-mounting unit 12.

The developer cartridge 7 includes a case 13 that accommodates toner. A hopper 14 and a developing chamber 15 are formed inside the case 13. The hopper 14 and developing chamber 15 are adjacent in the front-rear direction and in communication with each other.

The hopper 14 is a space for accommodating toner. An agitator 16 is disposed inside the hopper 14. The agitator 16 is formed of a resinous film and is affixed to an agitator shaft 17 that extends in the left-right direction. The agitator 16 is capable of rotating together with the agitator shaft 17. By rotating, the agitator 16 agitates toner accommodated in the hopper 14 and supplies the toner from the hopper 14 into the developing chamber 15.

A developing roller 18 (a developer carrying member) and a supply roller 19 (a developer supplying member) are provided in the developing chamber 15, respectively. The developing roller 18 is rotatably provided on a developing-roller shaft 20, and the supply roller 19 is rotatably provided on a supply-roller shaft 21. Both the developing-roller shaft 20 and supply-roller shaft 21 are oriented in the left-right direction. The developing roller 18 is positioned in the developing chamber 15 so that a portion of its peripheral surface is exposed through the rear end of the case 13. The developer cartridge 7 is mounted in the drum cartridge 6 such that the surface of the developing roller 18 contacts the peripheral surface of the photosensitive drum 9. The supply roller 19 is disposed so that its peripheral surface contacts the surface of the developing roller 18 from the lower front side thereof. The supply roller 19 supplies toner from the developing chamber 15 onto the surface of the developing roller 18 so that the developing roller 18 carries a thin layer on its surface.

An exposure unit 22 is also provided in the main casing 2 above the process cartridge 5. The exposure unit 22 includes a laser light source and the like.

During an image-forming operation, the photosensitive drum 9 rotates clockwise in a left-side view at a constant velocity. As the photosensitive drum 9 rotates, the charger 10 applies a uniform charge to the surface of the photosensitive drum 9 through electrical discharge. In the meantime, the exposure unit 22 emits a laser beam based on image data received from a personal computer (not shown) connected to the laser printer 1. The laser beam passes between the charger 10 and developer cartridge 7 and is irradiated on the surface of the positively charged photosensitive drum 9. By selectively exposing the surface of the photosensitive drum 9, electrical charge is selectively removed from the exposed regions of the photosensitive drum 9, forming an electrostatic latent image on the surface of the photosensitive drum 9. As the photosensitive drum 9 rotates and brings the latent image opposite the developing roller 18, the developing roller 18 supplies toner onto the latent image, forming a toner image on the surface of the photosensitive drum 9.

A sheet-feeding cassette 23 is disposed in the bottom section of the main casing 2. The sheet-feeding cassette 23 accommodates sheets P of paper. A pickup roller 24 is disposed above the front end of the sheet-feeding cassette 23 for feeding sheets P from the sheet-feeding cassette 23 to be printed.

A conveying path 25 is formed inside the main casing 2. The conveying path 25 is S-shaped in a side view and leads from the sheet-feeding cassette 23 to a discharge tray 26 formed on the top surface of the main casing 2 while passing between the photosensitive drum 9 and transfer roller 11. A separating roller 27 and separating pad 28 disposed in confrontation with each other, a pair of feeding rollers 29, a pair of registration rollers 30, and a pair of discharge rollers 31 are provided on the conveying path 25 in sequence along the conveying direction of the sheet P.

Sheets P fed from the sheet-feeding cassette 23 pass between the separating roller 27 and separating pad 28, where they are separated so that only one sheet is conveyed at a time. The feeding rollers 29 subsequently convey the sheets toward the registration rollers 30. The registration rollers 30 then convey the sheets P to a position between the photosensitive drum 9 and transfer roller 11 at a precise timing.

As the photosensitive drum 9 rotates to bring the toner image on its peripheral surface opposite the sheet P passing between the photosensitive drum 9 and transfer roller 11, the toner image is transferred onto the sheet P by the electrical attraction of the transfer roller 11.

A fixing unit 32 is provided along the conveying path 25 downstream of the transfer roller 11 in the paper-conveying direction. A sheet P conveyed along the conveying path 25 passes through the fixing unit 32 after having the toner image transferred thereon. The fixing unit 32 applies heat and pressure to the sheet P for fixing the toner image to the same.

The laser printer 1 is provided with two operating modes: a single-sided mode for forming a toner image on one surface of the sheet P, and a duplex mode for forming a toner image on one surface of the sheet P and subsequently forming another toner image on the other surface of the sheet P.

In the single-sided mode, the discharge rollers 31 discharge the sheet P onto the discharge tray 26 after a toner image has been formed on one side surface.

In order to implement the duplex mode, a reverse conveying path 33 is also formed in the main casing 2. The reverse conveying path 33 extends between the conveying path 25 and sheet-feeding cassette 23 from a point near the discharge rollers 31 to a portion of the conveying path 25 between the feeding rollers 29 and registration rollers 30. Along the reverse conveying path 33 are provided a pair of first reverse conveying rollers 34, and a pair of second reverse conveying rollers 35.

In the duplex mode, the discharge rollers 31 do not discharge the sheet P onto the discharge tray 26 after an image has been formed on one side surface thereof, but instead convey the sheet P onto the reverse conveying path 33. The first reverse conveying rollers 34 and second reverse conveying rollers 35 sequentially convey the sheet P along the reverse conveying path 33 to the conveying path 25, effectively inverting the sheet P so that the surface on which an image has not been formed confronts the peripheral surface of the photosensitive drum 9. After an image is formed on the other side surface of the sheet P, the duplex image-forming process is complete, and the discharge rollers 31 discharge the sheet P onto the discharge tray 26.

2. Drum Cartridge

Figure 2:
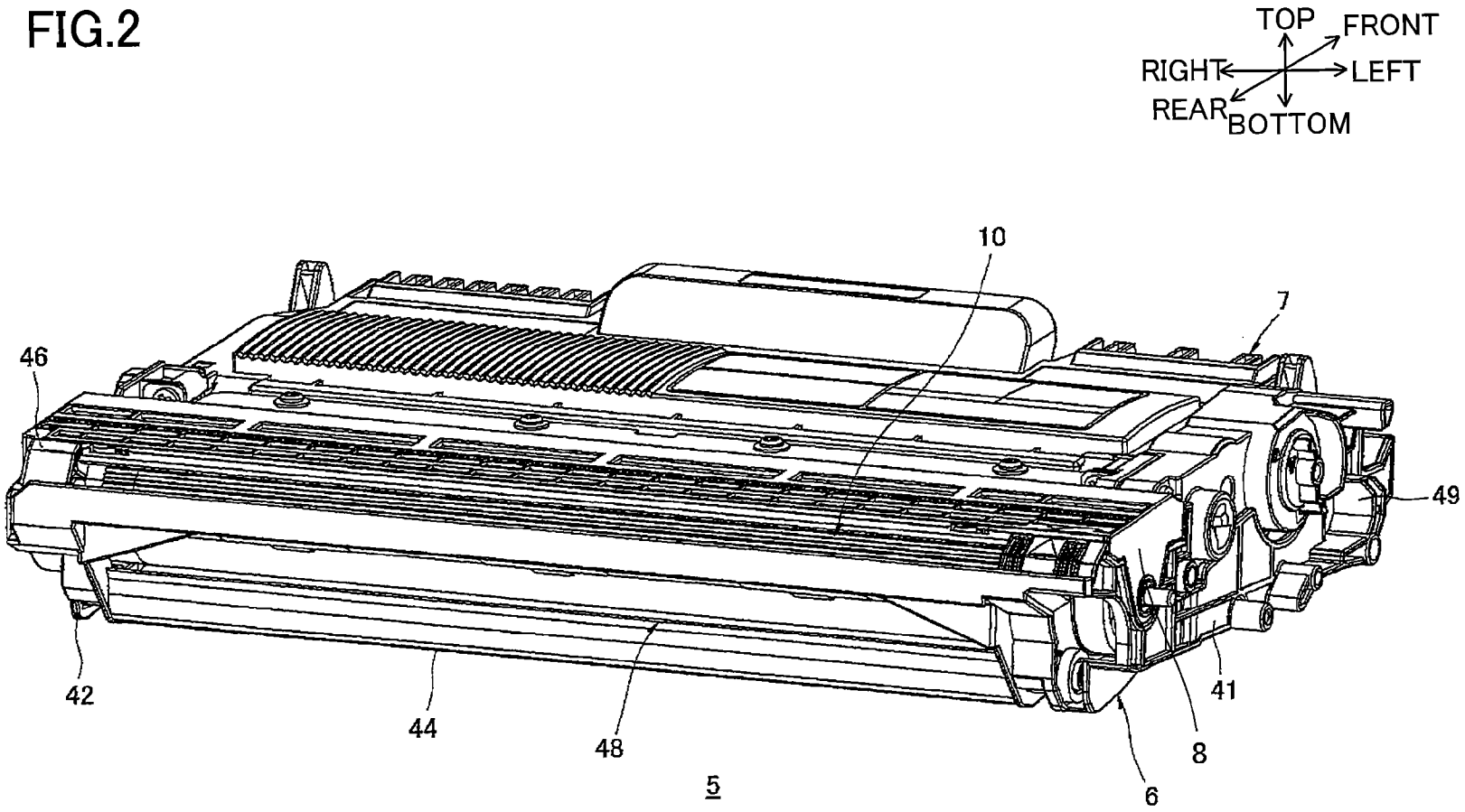
FIG. 2 is a perspective view as viewed from a left rear side of the process cartridge shown in FIG. 1.
Figure 3:
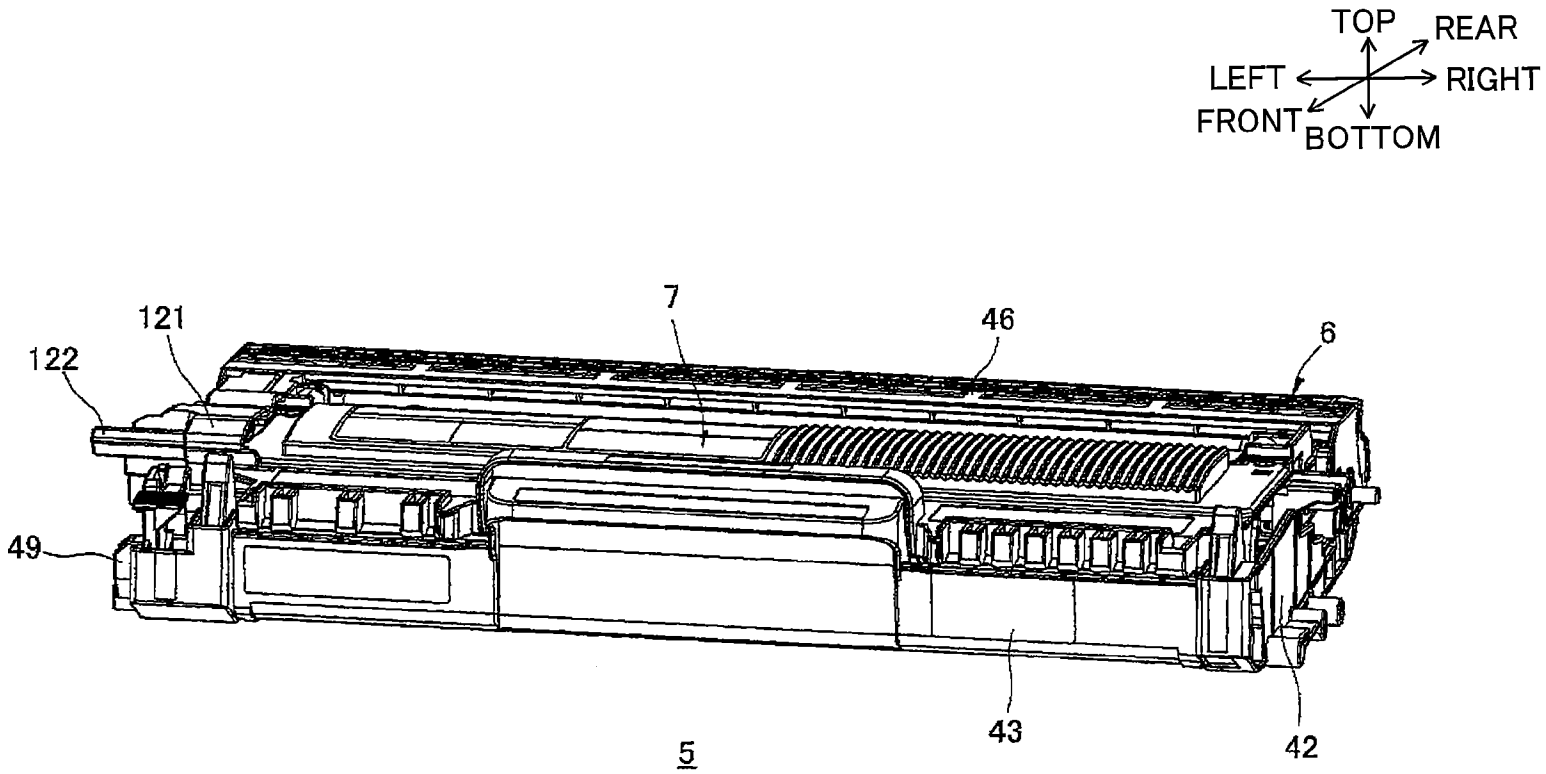
FIG. 3 is a perspective view as viewed from a right front side of the process cartridge shown in FIG. 1.

As shown in FIGS. 2 and 3, the drum frame 8 of the drum cartridge 6 is configured of a left wall 41 and a right wall 42. The left and right walls 41 and 42 of the drum frame 8 are both plate-shaped and elongated in the front-rear direction. The left and right walls 41 and 42 are disposed parallel to and are spaced apart in the left-right direction. A front wall 43 bridges the front edges of the left and right walls 41 and 42, and a rear wall 44 bridges the rear edges of the left and right walls 41 and 42. As shown in FIG. 1, a bottom wall 45 bridges the lower edges of the left and right walls 41 and 42. As shown in FIGS. 2 and 3, a top wall 46 bridges the top edges of the left and right walls 41 and 42 on the rear side thereof so as to provide a top cover over the rear section of the drum frame 8.

The photosensitive drum 9 and transfer roller 11 are rotatably supported in the left and right walls 41 and 42 between the top wall 46 and bottom wall 45. As shown in FIG. 1, an opening 47 is formed in the bottom wall 45 at a position forward of the photosensitive drum 9 and transfer roller 11 for allowing the sheets P to pass through the bottom wall 45. Further, an opening 48 is formed in the rear wall 44 at a position confronting the contact point between the photosensitive drum 9 and transfer roller 11 for allowing the sheets P to pass through the rear wall 44. Thus, a sheet P enters the drum cartridge 6 through the opening 47 and, after passing between the photosensitive drum 9 and transfer roller 11, exits the drum cartridge 6 through the opening 48. As shown in FIGS. 1 and 2, the charger 10 is provided on the top wall 46.

As shown in FIG. 2, an incompatibility protrusion 49 is formed on the front end of the left wall 41 and protrudes leftward therefrom. The incompatibility protrusion 49 first extends vertically upward, bends and extends downward, and bends and extends rearward.

3. Developer Cartridge (1) Case

Figure 4:
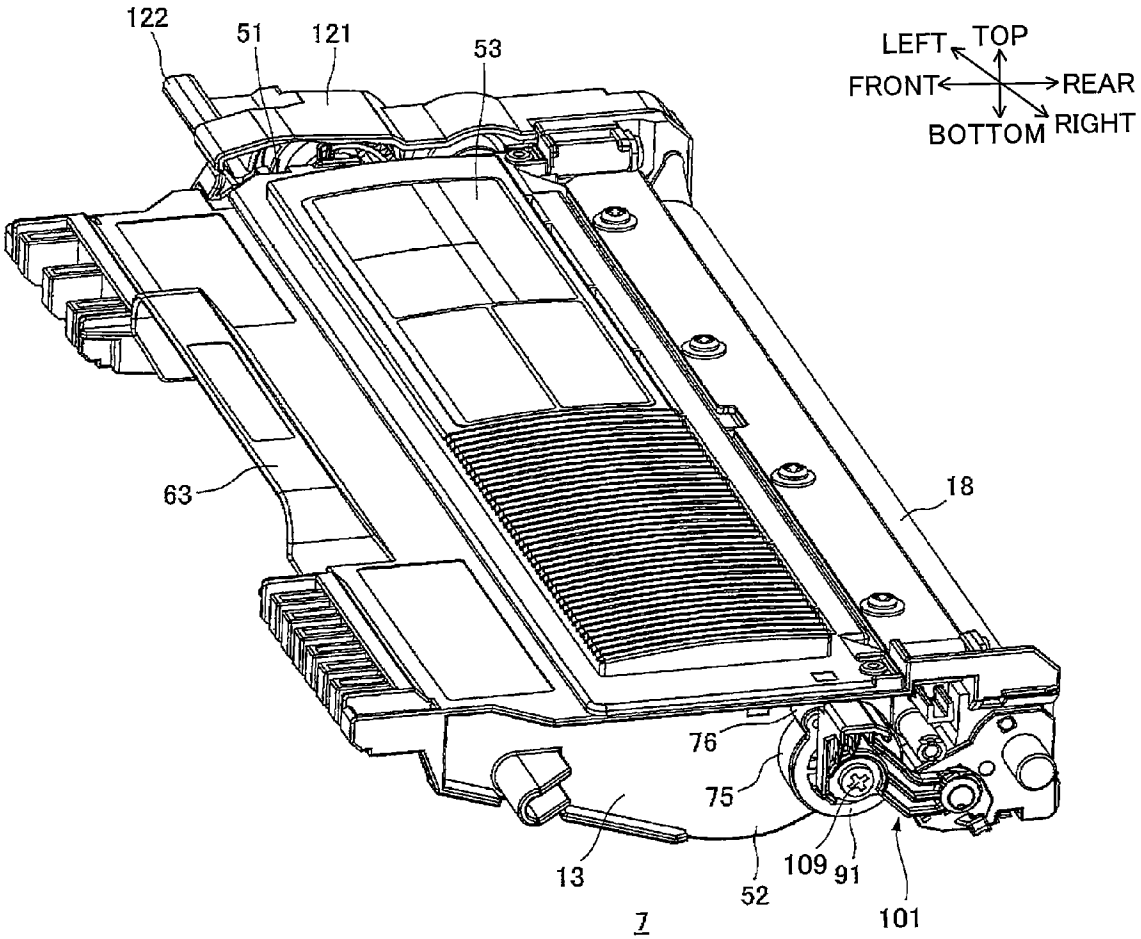
FIG. 4 is a perspective view of the developer cartridge as viewed from a right front top side thereof.
Figure 5:
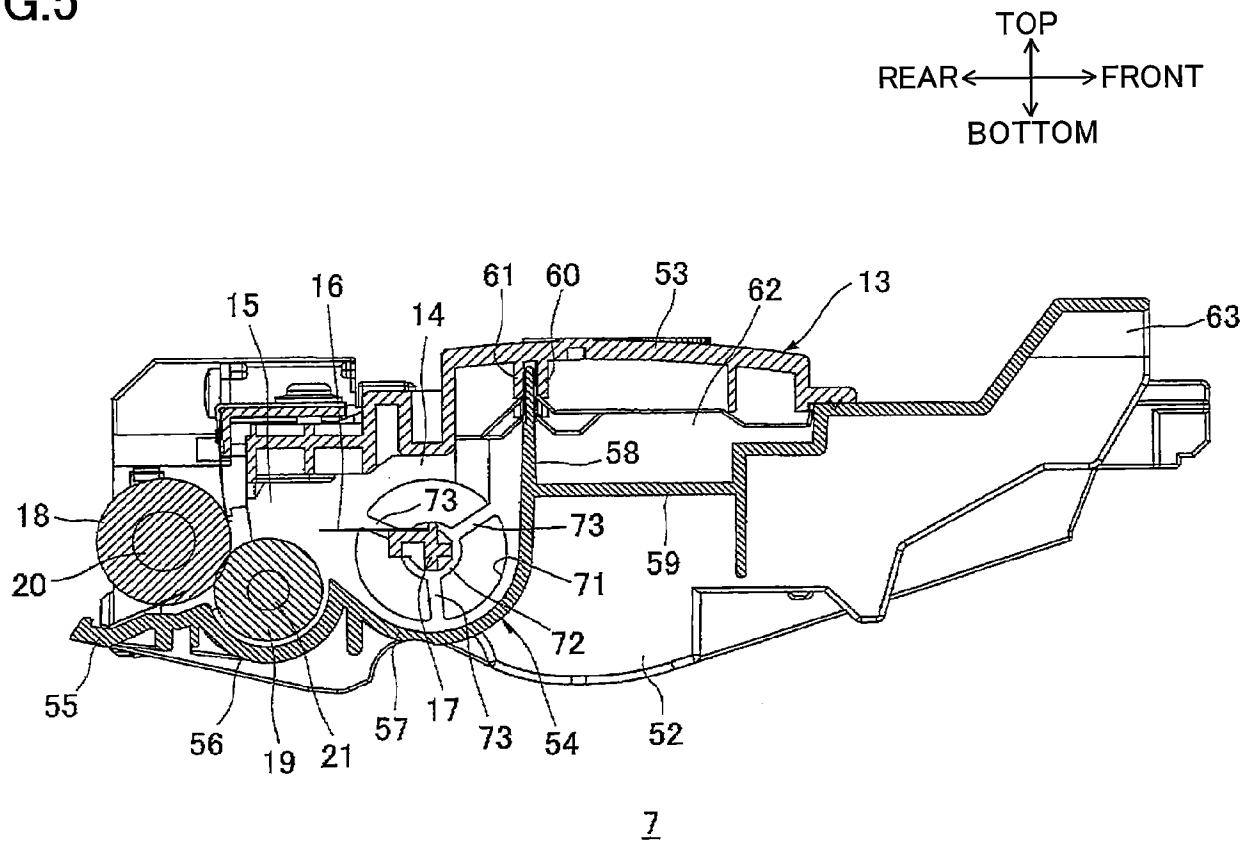
FIG. 5 is a cross-sectional view of the developer cartridge shown in FIG. 4.

The case 13 of the developer cartridge 7 is formed of a resin such as polystyrene. As shown in FIG. 4, the case 13 includes a left wall 51 (a second side wall) and a right wall 52 (a first side wall) arranged parallel to each other and spaced apart in the left-right direction. As shown in FIG. 5, the case 13 further includes a top wall 53 bridging the top edges of the left and right walls 51 and 52, and a bottom wall 54 bridging the bottom edges of the left and right walls 51 and 52.

Figure 6:
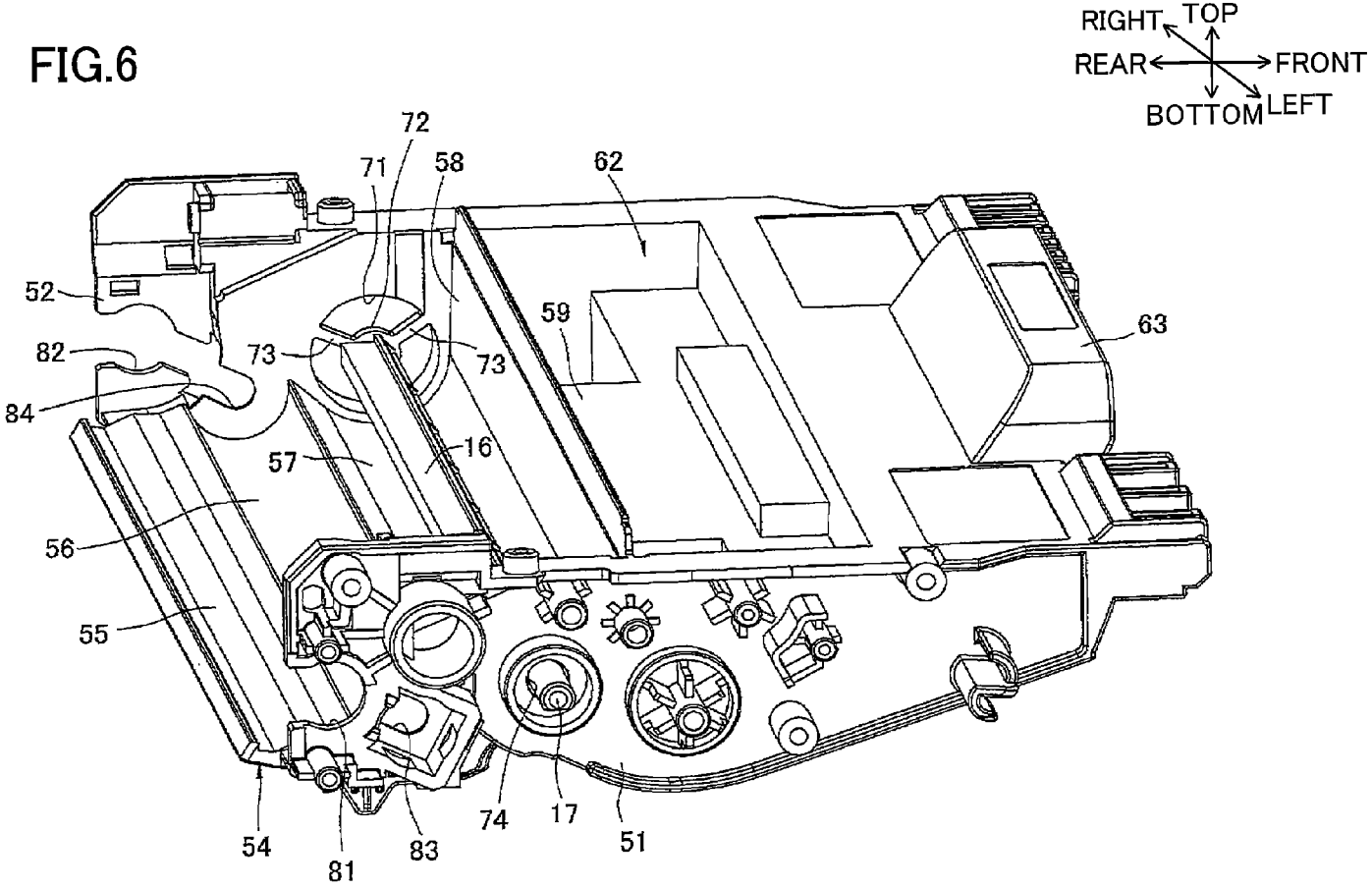
FIG. 6 is a perspective view of the developer cartridge as viewed from a left rear top side thereof, and particularly showing an agitator, and a case including left and right side walls and a bottom wall.

As shown in FIGS. 5 and 6, the bottom wall 54 is integrally configured of a lip part 55 that extends farther rearward than the rear edge of the top wall 53 and confronts the developing roller 18 from below; a first curved part 56 that has a semicircular cross section and extends forward from the front edge of the lip part 55 while curving about the bottom peripheral surface of the supply roller 19; a second curved part 57 having a semicircular cross section that extends forward from the front edge of the first curved part 56 while curving downward and back upward so that its convex side faces downward; a partitioning part 58 extending upward from the front (top) edge of the second curved part 57; and a bent part 59 that extends forward from a vertical midpoint of the partitioning part 58 while bending in steps that are progressively higher toward the front.

A pair of ribs 60 and 61 is formed on the bottom surface of the top wall 53 at a midpoint in the front-rear direction thereof. The ribs 60 and 61 span across the entire left-right dimension of the top wall 53 and are separated by a small gap in the front-rear direction. A sealing material (not shown) is provided between the ribs 60 and 61. The top edge of the partitioning part 58 constituting the bottom wall 54 is inserted between the ribs 60 and 61 and placed in contact with the sealing material. The front edge of the top wall 53 is bonded to a front-rear midpoint of the bent part 59 constituting the bottom wall 54. The portion of the bent part 59 positioned to the rear of the bonded portion is separated from the top wall 53, forming a space 62 on the front side of the partitioning part 58 that is defined by the left wall 51, right wall 52, top wall 53, partitioning part 58, and bent part 59. The hopper 14 and developing chamber 15 are formed on the rear side of the partitioning part 58. Thus, the hopper 14 and developing chamber 15 are completely separated from the space 62 by the partitioning part 58 and the sealing material.

The partitioning part 58 may be formed separately from the rest of the bottom wall 54. With this construction, the space 62 can be used to accommodate toner by removing the partitioning part 58, thereby increasing the capacity of the developer cartridge 7 for accommodating toner. Therefore, bottom walls 54 formed in the same mold can be used to manufacture both a small-capacity developer cartridge 7 having a relative small toner-accommodating capacity, and a large-capacity developer cartridge 7 having a relatively large toner-accommodating capacity.

A grip part 63 is formed on the front end of the bent part 59. The center portion of the grip part 63 in the left-right direction bulges upward, forming a general C-shape in a front-side view with the opening of the "C" facing downward. The user or the like grips the grip part 63 by hand to carry the developer cartridge 7. Bonding the top wall 53 to a front-rear midpoint of the bent part 59 ensures that the bent part 59 remains rigid when the user grips the grip part 63.

The hopper 14 is a space formed above the second curved part 57.

Figure 7:
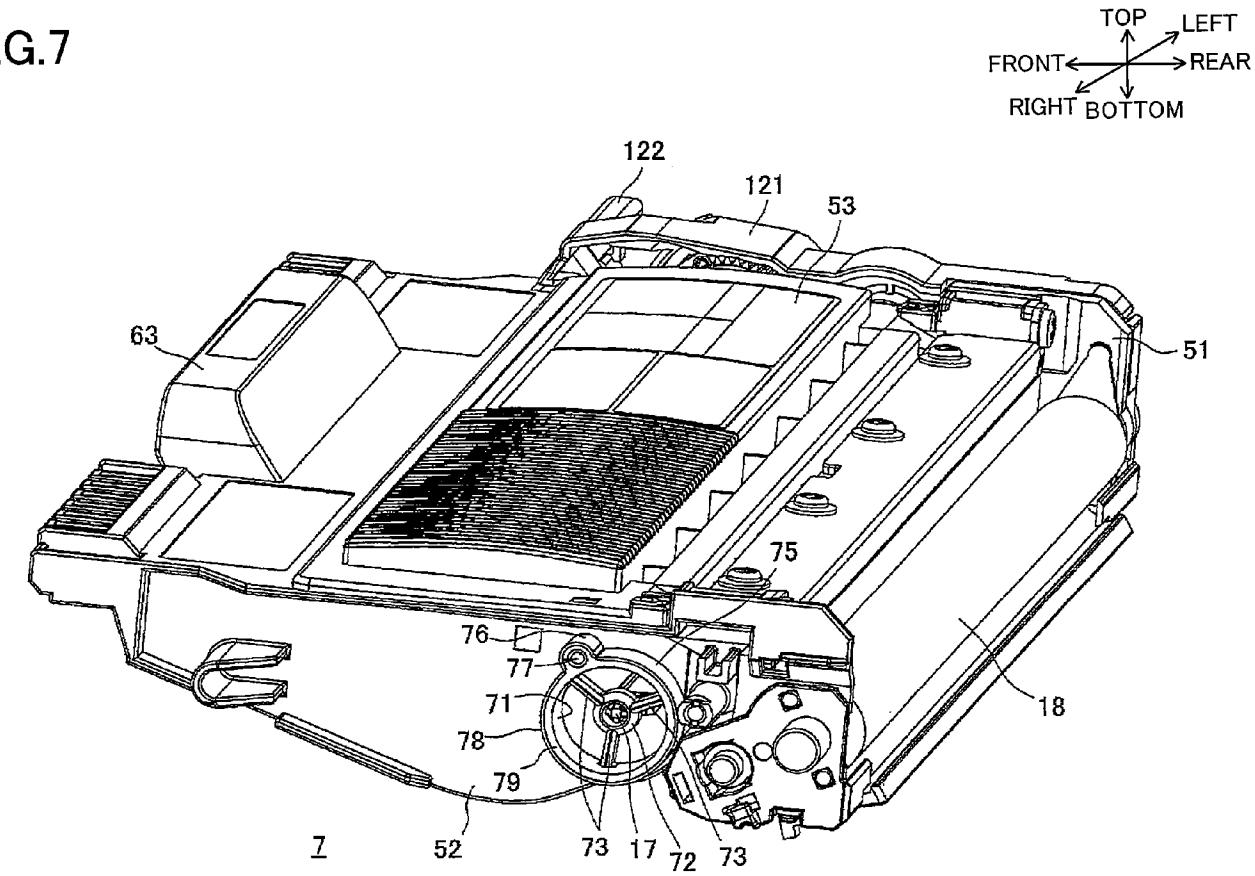
FIG. 7 is a perspective view of the developer cartridge as viewed from the a right rear side thereof, in which a cap, a supply electrode and the developer electrode are omitted.

As shown in FIG. 6, a round toner fill-hole 71 (a toner fill-hole) is formed in a region of the right wall 52 facing the hopper 14. As shown in FIG. 7, an agitator bearing ring 72 and three ring support parts 73 are formed inside the toner fill-hole 71. The agitator bearing ring 72 is provided in the center of the toner fill-hole 71. The ring support parts 73 are thin bar-like members that span between the inner circumferential surface of the toner fill-hole 71 and the outer circumferential surface of the agitator bearing ring 72. The three ring support parts 73 extend radially from the agitator bearing ring 72 at equal angles (intervals of 120 degrees).

A round agitator bearing hole 74 is formed in the left wall 51 at a position opposing the agitator bearing ring 72 in the left-right direction.

Figure 8:
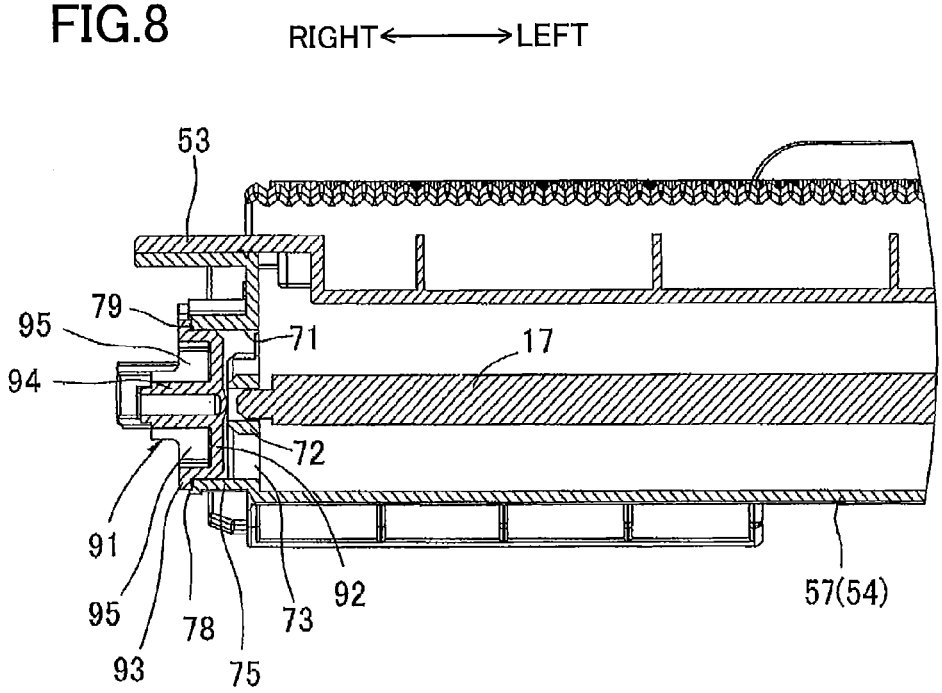
FIG. 8 is a cross-sectional view of a right end portion of the developer cartridge taken along a plane containing a central axis of a toner fill-hole.

As shown in FIGS. 6 through 8, the right and left ends of the agitator shaft 17 are rotatably inserted into the agitator bearing ring 72 and agitator bearing hole 74, respectively. With this configuration, the agitator shaft 17 (and, hence, the agitator 16) is capable of rotating about an axis aligned with the center of the toner fill-hole 71.

Accordingly, the orientation of the agitator 16 is visible from the outside of the case 13 through the toner fill-hole 71. This construction makes it easy to confirm that the agitator shaft 17 is retained in the agitator bearing ring 72 and agitator bearing hole 74.

The toner fill-hole 71 is used for filling the hopper 14 with toner. By configuring the ring support parts 73 of thin bar-like members, sufficiently large openings can be maintained between the ring support parts 73 for allowing the hopper 14 to be smoothly filled with toner.

As shown in FIG. 7, the cross section of the ring support part 73 taken orthogonal to the longitudinal direction is shaped like the home plate on a baseball field, tapering toward the right. Hence, when the hopper 14 is being filled with toner, the toner is readily introduced into the hopper 14 along the tapered cross-sectional shape of the ring support part 73. Hence, the hopper 14 can be smoothly filled with toner.

The right end of the agitator shaft 17 has a cross-like shape when viewed from the right side. When the right end of the agitator shaft 17 is inserted into the agitator bearing ring 72, gaps are formed between the right end of the agitator shaft 17 and the inner peripheral surface of the agitator bearing ring 72. Therefore, toner can enter the hopper 14 through these gaps when the hopper 14 is being filled with toner, enabling the hopper 14 to be filled more smoothly.

The agitator bearing hole 74 of the left wall 51 also functions as an air release opening when residual toner is being extracted from the hopper 14 through the toner fill-hole 71. Thus, residual toner can be smoothly extracted from the hopper 14.

As shown in FIGS. 7 and 8, a fitting wall part 75 is formed on the right wall 52. The fitting wall part 75 protrudes rightward from the periphery of the toner fill-hole 71. The inner peripheral surface of the fitting wall part 75 is a cylindrical surface formed continuously with the inner peripheral surface of the toner fill-hole 71. As shown in FIG. 7, an engagement part 76 (a predetermined portion) is integrally formed on an outer circumferential part of the fitting wall part 75. The engagement part 76 protrudes diagonally upward and forward from the fitting wall part 75. An engagement recess 77 is formed in the engagement part 76. The engagement recess 77 is circular in a side view and is recessed leftward (inward) from the right surface of the engagement part 76. A flange 78 is integrally formed along the outer peripheral edges of the fitting wall part 75 and engagement part 76, expanding radially outward from the fitting wall part 75 and engagement part 76. As shown in FIG. 8, the flange 78 (an attachment portion) has a stepped surface 79 formed by bending the outer peripheral edge of the flange 78 rightward. The stepped surface 79 is recessed relative to the rightmost surface of the flange 78.

As shown in FIG. 6, developing-roller bearing holes 81 and 82 are formed in the left and right walls 51 and 52, respectively, at positions above the lip part 55. The developing-roller bearing holes 81 and 82 penetrate the left and right walls 51 and 52 in the left-right direction and open outward in the rear edges of the left and right walls 51 and 52. The left and right ends of the developing-roller shaft 20 are inserted through the open rear edges of the developing-roller bearing holes 81 and 82 so that the developing-roller shaft 20 is rotatably supported in the developing-roller bearing holes 81 and 82. Both ends of the developing-roller shaft 20 protrude outward from the left and right walls 51 and 52.

Similarly, supply-roller bearing holes 83 and 84 are formed in the left and right walls 51 and 52, respectively, at positions above the first curved part 56. The supply-roller bearing holes 83 and 84 penetrate the left and right walls 51 and 52 to form a groove that is U-shaped in a side view with the opening of the "U" on the rear. The left and right ends of the supply-roller shaft 21 are respectively inserted into the supply-roller bearing holes 83 and 84 from the rear side thereof so that the supply-roller shaft 21 is rotatably supported in the supply-roller bearing holes 83 and 84. The ends of the supply-roller shaft 21 protrude outward from the left and right walls 51 and 52.

(2) Cap

Figure 9:
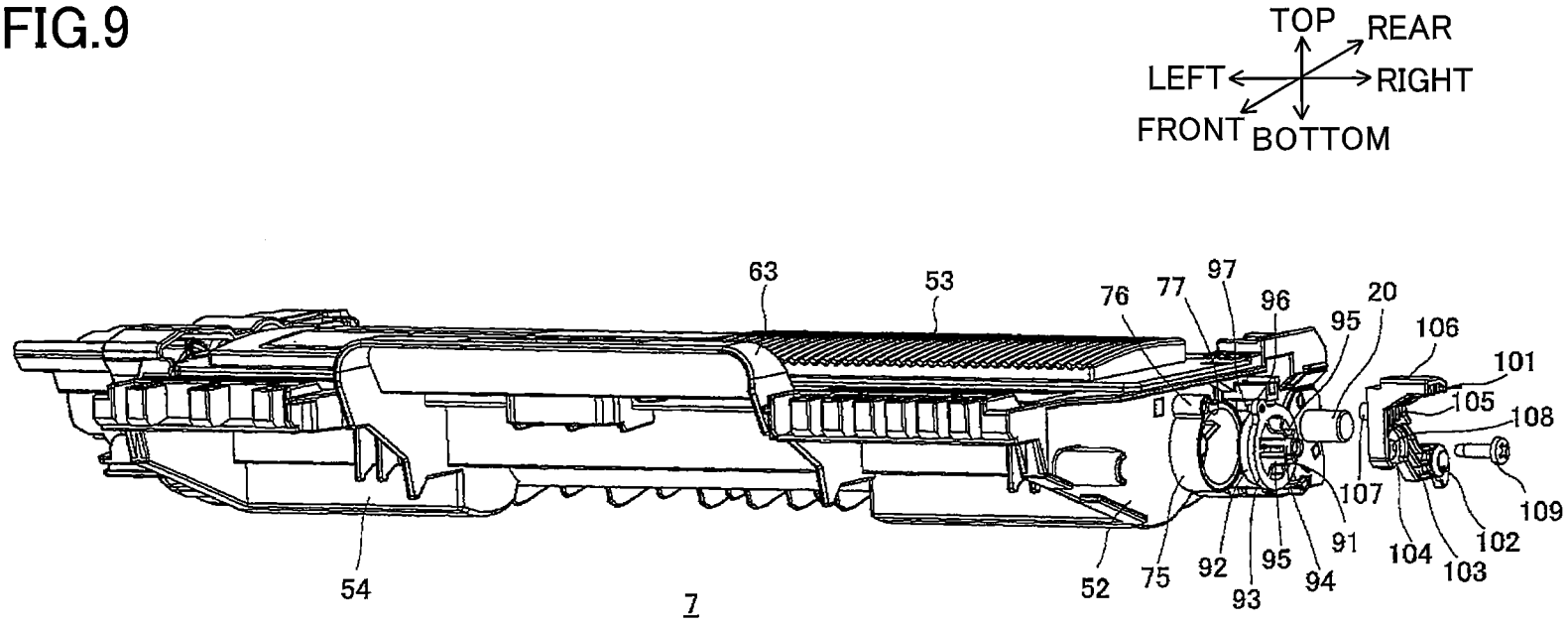
FIG. 9 is an exploded perspective view of the developer cartridge as viewed from the right front side thereof, in which the cap, the supply electrode, and a screw are unfastened from the case, while a developer electrode is omitted.

As shown in FIG. 8, a cap 91 is fitted into the fitting wall part 75 of the case 13. The cap 91 is formed of the same resin as the case 13 and functions to seal the toner fill-hole 71. As shown in FIGS. 8 and 9, the cap 91 is integrally formed of a main body part 92, a circumferential part 93, a boss 94, and six ribs 95. The cap 91 also functions to fix a supply electrode 101 described later.

The main body part 92 of the cap 91 is the portion that is fitted inside the fitting wall part 75. The main body part 92 has an angular C-shape in a cross-sectional view and is integrally configured of a cylindrical part that contacts the inner peripheral surface of the fitting wall part 75, and a part for closing the left end of the cylindrical part.

The circumferential part 93 protrudes radially outward from the right edge of the main body part 92 to form a flange that contacts the stepped surface 79 of the fitting wall part 75. The circumferential part 93 is welded to the stepped surface 79. Thus, the border between the stepped surface 79 and circumferential part 93 is not exposed on the outer side. This construction prevents a tool or the like from being inserted into the border between the stepped surface 79 and circumferential part 93, thereby preventing the cap 91 from inadvertently being pulled out of the toner fill-hole 71. By welding the circumferential part 93 of the cap 91 to the stepped surface 79, the cap 91 is firmly fixed to the fitting wall part 75, enabling the supply electrode 101 (described later), which is fixed to the cap 91, to be maintained in a fixed position with greater stability.

As shown in FIG. 9, an engaging part 96 for engaging with the engagement part 76 is formed on the circumferential part 93. A columnar protrusion 97 is formed on the left endface of the engaging part 96 to be fitted into the engagement recess 77. Fitting the columnar protrusion 97 into the engagement recess 77 fixes the position of the cap 91 relative to the fitting wall part 75 in the circumferential direction of the toner fill-hole 71.

Figure 10:
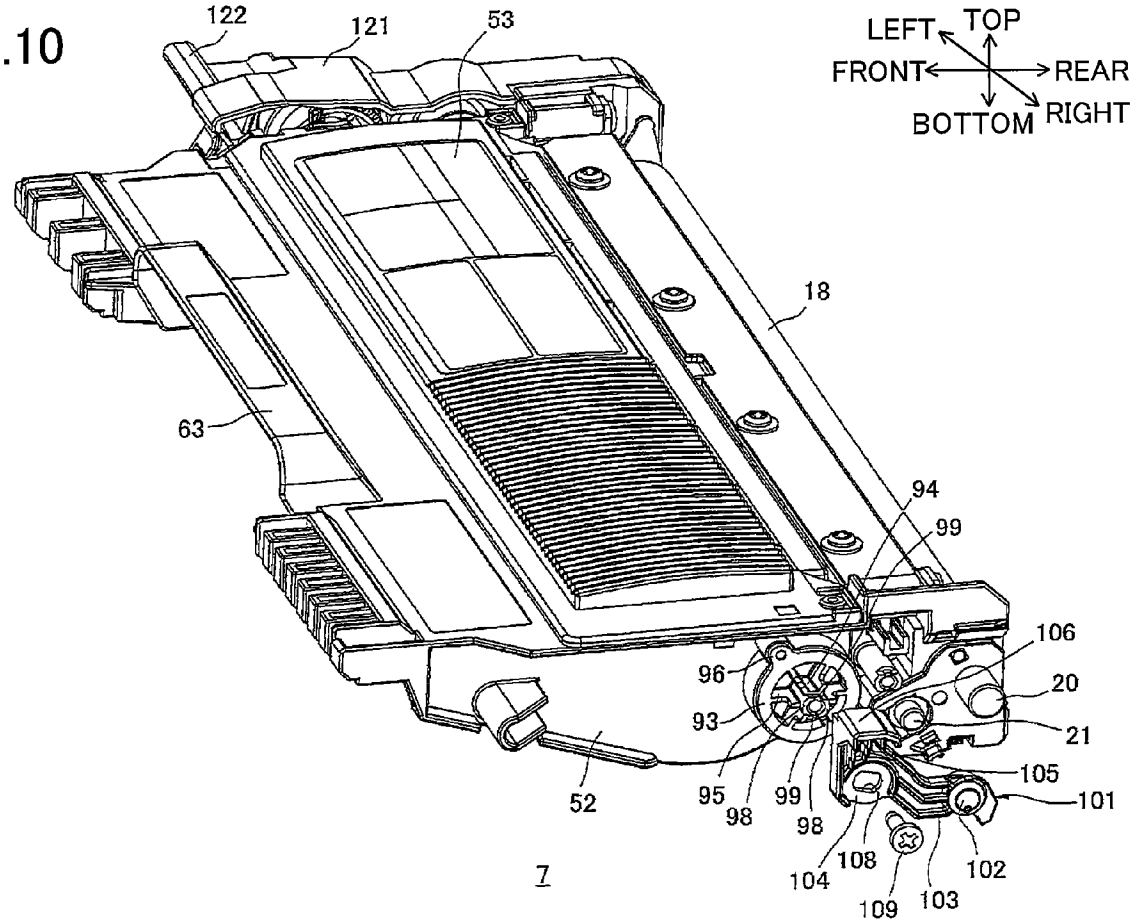
FIG. 10 is an exploded perspective view of the developer cartridge as viewed from right front top side thereof, in which the supply electrode and the screw are unfastened from the case, while the developer electrode is omitted.

The boss 94 (an electrode mounting portion) has a general cylindrical shape and extends rightward from the main body part 92 along the central axis of the main body part 92 (toner fill-hole 71). As shown in FIG. 10, the right end of the boss 94 has a general elliptical shape formed by cutting off circumferential parts of the cylindrical shape that have rotational symmetry. As a result, the right end of the boss 94 has wide parts 98 positioned on either side of the hollow region in the longitudinal direction of the substantially elliptical shape, and narrow parts 99 positioned on either side of the hollow region in the latitudinal direction of the elliptical shape.

The six ribs 95 are formed to extend radially from the outer circumferential surface of the boss 94 toward the main body part 92.

(3) Electrodes

Figure 11:
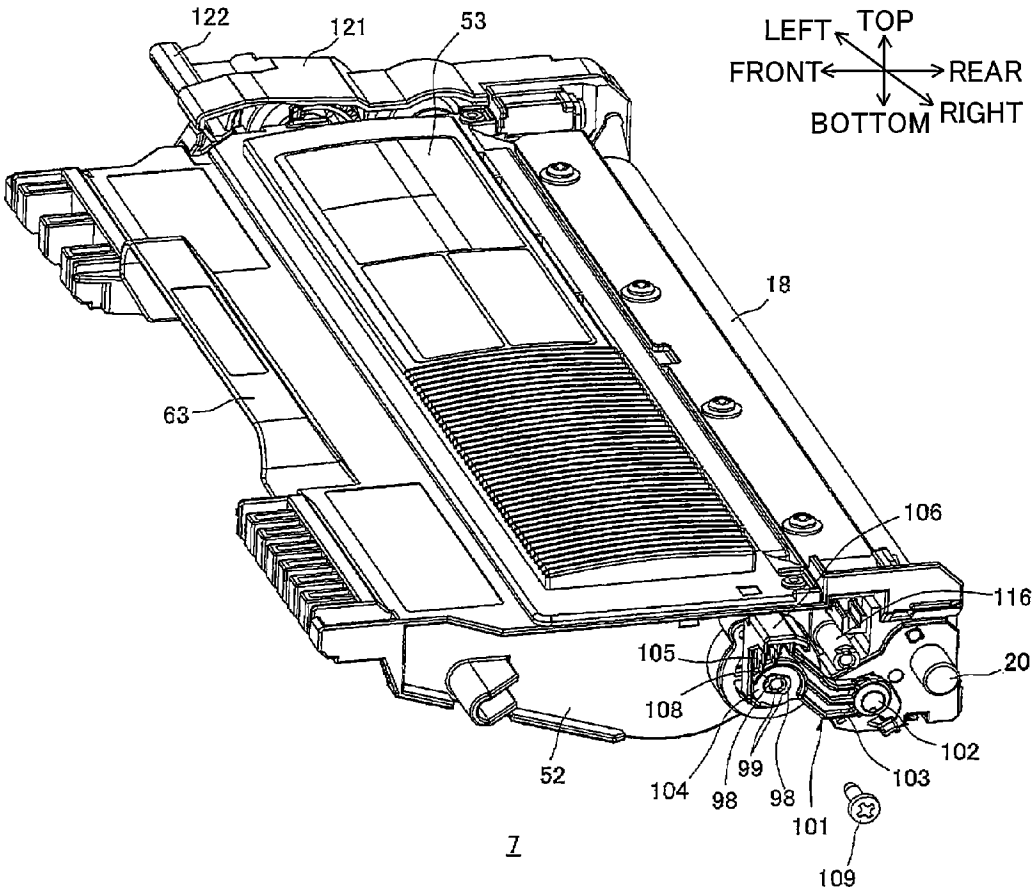
FIG. 11 is an exploded perspective view of the developer cartridge as viewed from right front top side thereof, in which the screw are unfastened from the case, while the developer electrode is omitted.

As shown in FIGS. 9 through 11, a supply electrode 101 is provided on the developer cartridge 7 for supplying a bias voltage to the supply roller 19. The supply electrode 101 is formed of a conductive resin material and is integrally configured of a crowning part 102 that crowns the right end of the supply-roller shaft 21; a first extension part 103 extending from the crowning part 102 toward the boss 94 of the cap 91; a fixing part 104 formed on the distal end of the first extension part 103 for fixing the supply electrode 101 to the boss 94; a second extension part 105 extending upward from the fixing part 104; a contact point 106 formed on the upper edge of the second extension part 105 for contacting a body-side supply electrode (not shown) provided inside the main casing 2; and a contact part 107 (see FIG. 9) protruding outward from the left (rear) surface of the second extension part 105 for contacting the circumferential part 93 of the cap 91.

A fitting hole 108 is formed in the fixing part 104, penetrating the fixing part 104 in the left-right direction. The fitting hole 108 has a general elliptical shape that corresponds to the outer shape of the right end portion of the boss 94 (the portion of the boss 94 whose outer shape is generally elliptical).

With the crowning part 102 mounted over the right end portion of the supply-roller shaft 21, the right end of the boss 94 fitted into the fitting hole 108 formed in the fixing part 104, and the contact part 107 contacting the circumferential part 93 of the cap 91, the supply electrode 101 is fixed to the cap 91 by threading a screw 109 (a fixing member) into the center hollow portion of the boss 94. This construction prevents the screw 109 from damaging the supply electrode 101, even when the supply electrode 101 is formed of a relatively fragile conductive resin, since the shaft of the screw 109 is screwed into the hollow center portion (threaded hole) of the boss 94 provided on the cap 91.

The fixing part 104 is in contact with a stepped surface positioned a step lower than the right endface of the boss 94. The right surface of the fixing part 104 is flush with the right endface of the boss 94. The head of the screw 109 straddles and contacts both the right endface of the boss 94 and the right surface of the fixing part 104.

The supply electrode 101 is disposed in a position for overlapping the cap 91 in the left-right direction. The overlapping portion of the supply electrode 101 is fixed to the cap 91. With this construction, the supply electrode 101 is fixed via at least two parts, including the part of the supply electrode 101 connected to the supply-roller shaft 21 and the part of the supply electrode 101 overlapping the cap 91. Accordingly, the position of the supply electrode 101 can be maintained with stability.

Using the screw 109 to fix the supply electrode 101 to the cap 91 allows for fine adjustments in the position of the supply electrode 101. Thus, the supply electrode 101 can be placed in its optimum position through these fine adjustments. Further, if the supply electrode 101 becomes damaged, the damaged supply electrode 101 can easily be replace with a new supply electrode 101.

Positioning the supply electrode 101 to overlap the cap 91 can prevent the cap 91 from being removed inadvertently from the toner fill-hole 71.

Further, the fixing part 104 formed on the supply electrode 101 is fixed in contact with the boss 94 using the screw 109, while the contact part 107 formed on the supply electrode 101 contacts a portion of the cap 91 other than the boss 94. Accordingly, the supply electrode 101 is supported on the cap 91 at two points: the fixing part 104 and contact part 107. Thus, the position of the supply electrode 101 can be maintained with greater stability.

Providing the boss 94 with the wide parts 98 enhances the strength of the boss 94, while the narrow parts 99 of the boss 94 enable a screw 109 with a small head to apply pressure through its head to the portions of the fixing part 104 around the fitting hole 108, without the use of a washer. Accordingly, the screw 109 used for fixing the supply electrode 101 may be the same screw used in other parts of the developer cartridge 7.

By engaging the engaging part 96 with the engagement part 76, the cap 91 can be attached to the right wall 52 with the boss 94 in a fixed orientation. Since the boss 94, which has a generally elliptical outer shape, is set to a fixed orientation, the supply electrode 101 possessing the fitting hole 108, which also has a generally elliptical shape, can be set to a fixed orientation. Thus, the position of the supply electrode 101 can be maintained reliably in its fixed position.

Figure 12:
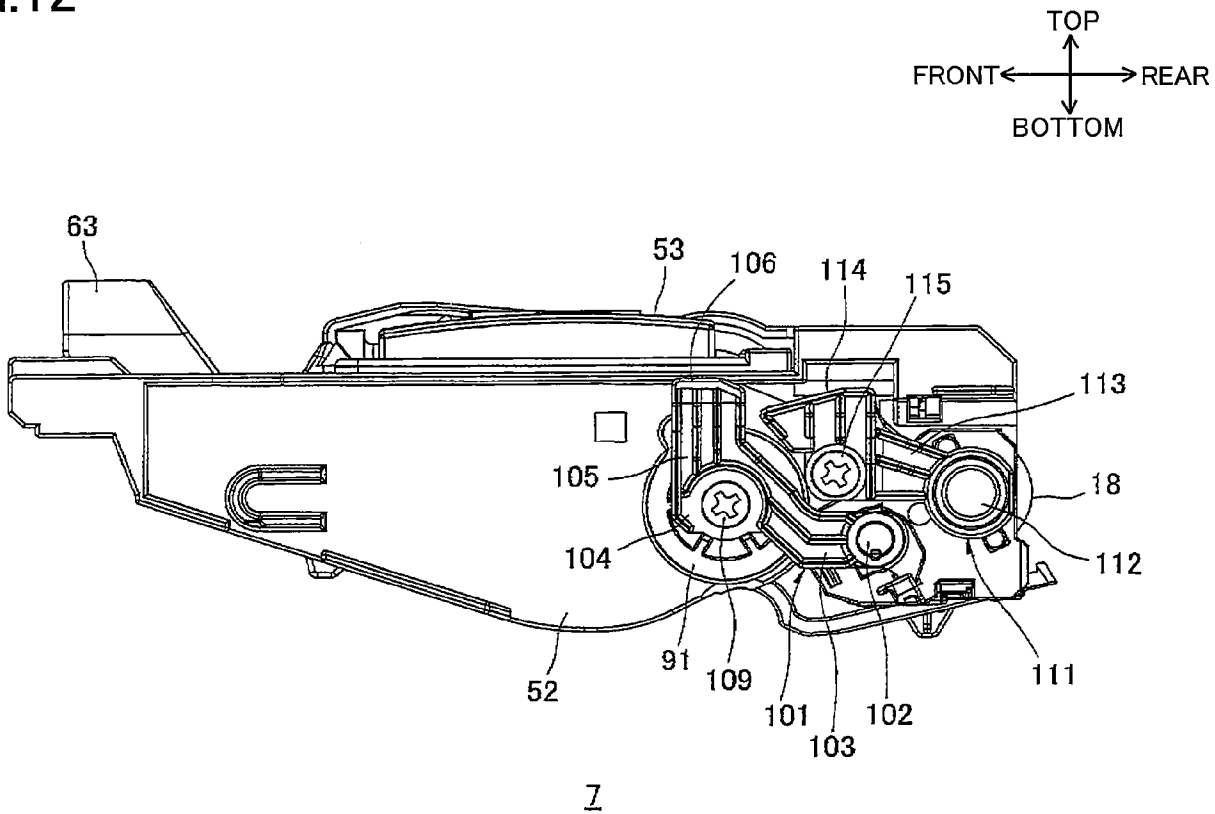
FIG. 12 is a right side view of the developer cartridge shown in FIG. 1.

As shown in FIG. 12, a developing electrode 111 is provided on the developer cartridge 7. The developing electrode 111 is formed of the same conductive resin as the supply electrode 101 and is integrally configured of a crowning part 112 that crowns the right end of the developing-roller shaft 20; an extension part 113 that extends forward from the crowning part 112, then bends and extends upward; and a contact point 114 formed on the top edge of the extension part 113 for contacting a body-side developing electrode (not shown) provided inside the main casing 2. The developing electrode 111 is fixed to the case 13 by a screw 115 inserted into the bent portion of the extension part 113. The screw 115 is screwed into a boss 116 (see FIG. 11) protruding from the case 13.

(4) Gear Cover

As shown in FIG. 4, a gear cover 121 is attached to the left side surface of the case 13. The gear cover 121 covers nearly the entire left side surface of the case 13. Gears inside the cartridge-mounting unit 12 are attached to the developing-roller shaft 20, supply-roller shaft 21, and the like. An incompatibility protrusion 122 is provided on the front edge of the gear cover 121 and extends leftward.

4. Mounting the Process Cartridge in the Main Casing

Figure 13:
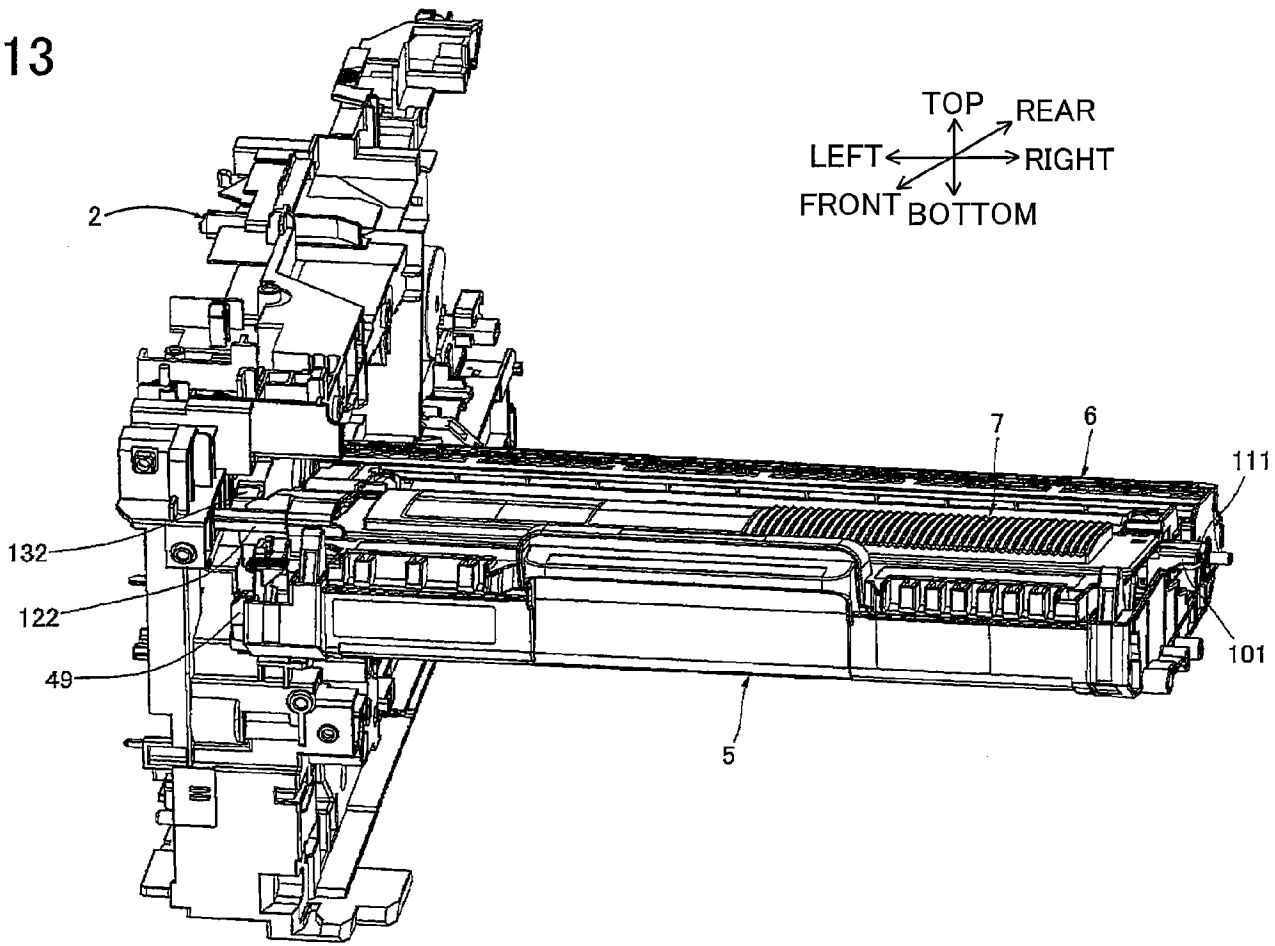
FIG. 13 is a perspective view of the process cartridge shown in FIG. 3 during assembly to the main casing.
Figure 14:
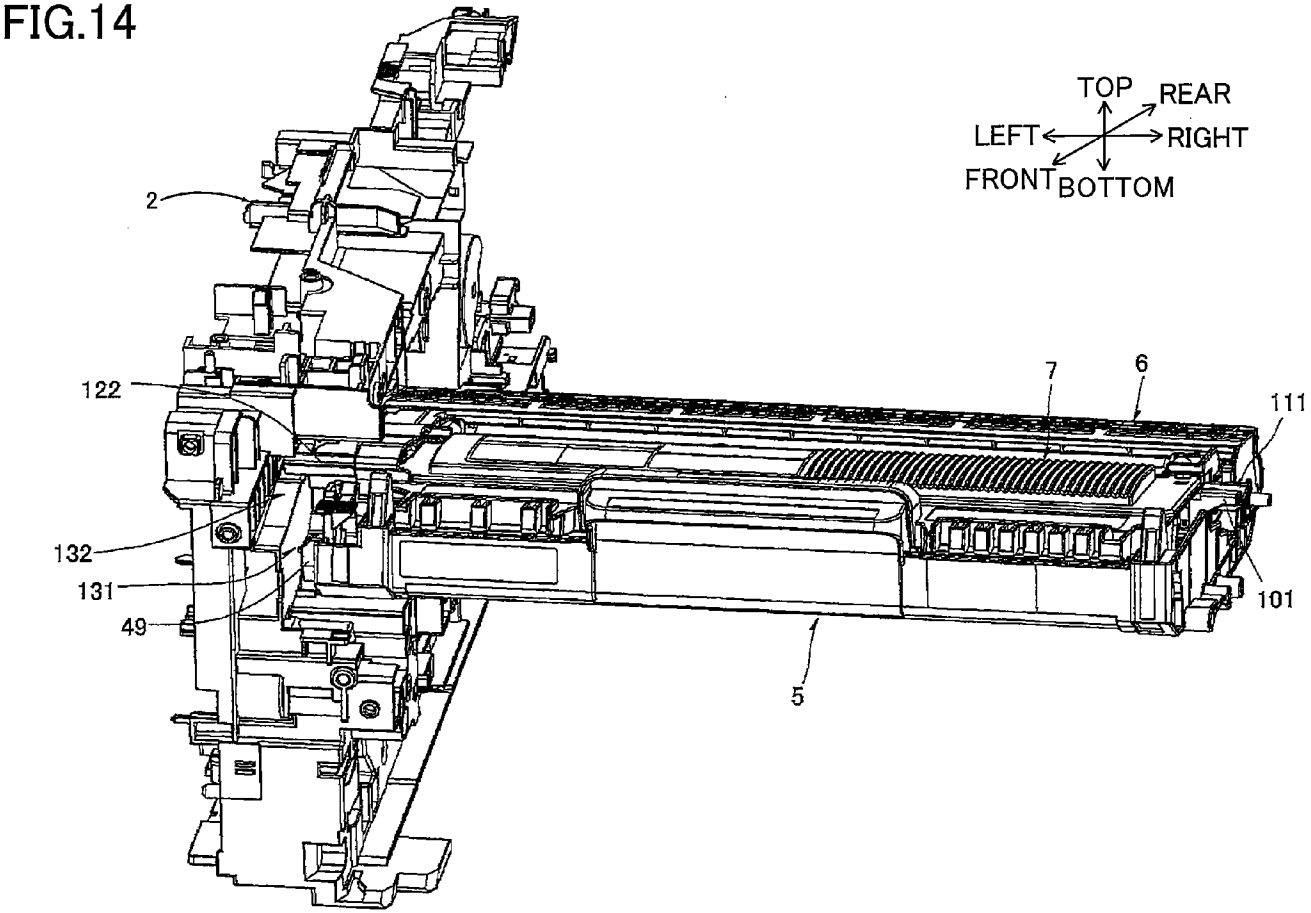
FIG. 14 is a perspective view of the process cartridge shown in FIG. 3 in a state where attachment of the process cartridge to the main casing 2 is completed.

As shown in FIGS. 13 and 14, spaces 131 and 132 are provided inside the main casing 2 for allowing passage of the incompatibility protrusion 49 of the drum cartridge 6 and the incompatibility protrusion 122 of the developer cartridge 7 when the process cartridge 5 is mounted in the main casing 2. In other words, no members are provided in regions through which the incompatibility protrusions 49 and 122 pass as the process cartridge 5 is mounted in or removed from the main casing 2.

Hence, with the front cover 4 in its open state, the process cartridge 5 is inserted into the main casing 2 via the cartridge-mounting opening 3, as shown in FIG. 13. Subsequently, the process cartridge 5 can be moved smoothly into the cartridge-mounted position shown in FIG. 14.

Figure 15:
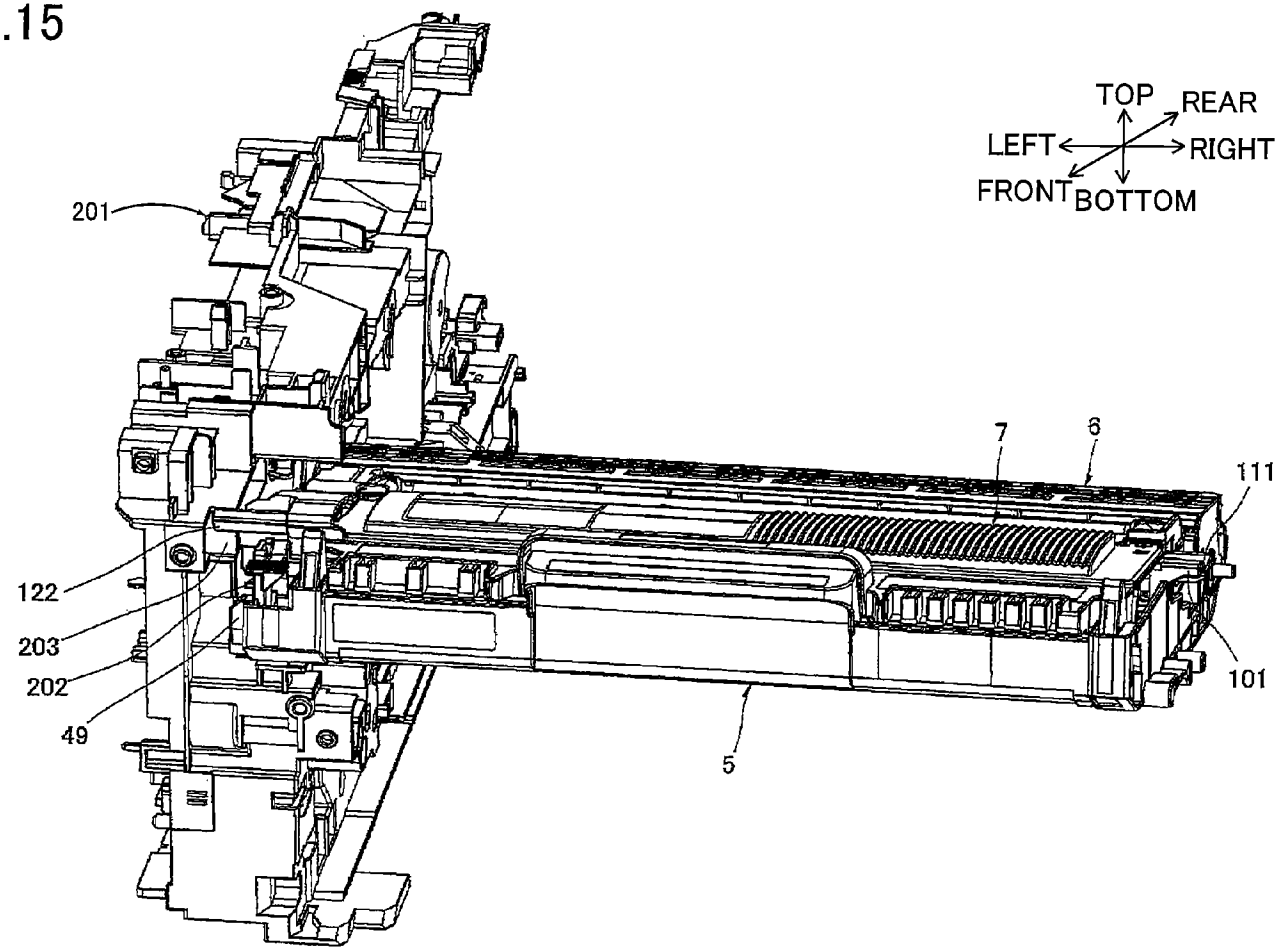
FIG. 15 is a perspective view of the process cartridge shown in FIG. 3 in a state where the process cartridge is inserted to a main casing of a laser printer which is incompatible with the process cartridge shown in FIG. 3.

However, if the process cartridge 5 is inserted into a main casing 201 of a printer different from the laser printer 1, as shown in the example of FIG. 15, the incompatibility protrusion 49 contacts a barrier 202 within the main casing 2 and/or the incompatibility protrusion 122 contacts a barrier 203 within the main casing 2 as the process cartridge 5 is inserted rearward, preventing the process cartridge 5 from moving farther rearward into a mounted position. This structure prevents the process cartridge 5 from being mounted in the main casing 201 of an incompatible printer. Further, since the incompatibility protrusions 49 and 122 are provided on the front ends of the drum cartridge 6 and developer cartridge 7, respectively, the state of contact between the incompatibility protrusions 49 and 122 and the corresponding barriers 202 and 203 can be confirmed visually.

The developer cartridge of the present invention has practical use in the image-forming industry as the cartridge can securely maintain the positions of its electrodes and can ensure good connections between its electrodes and electrodes provided in the body of an image-forming device.

While the invention has been described in detail and with reference to the embodiments thereof, it would be apparent to those skilled in the art that various changes and modifications may be made therein without departing from the scope and spirit of the invention.

What is claimed is:

1. A developer cartridge comprising:

a case having a first side wall formed with a toner fill-hole and a second side wall facing the first side wall in a particular direction, the case being configured to accommodate a developing agent therein;

a developer roller supported to the first side wall and the second side wall and rotatable about a rotation axis extending in an axial direction parallel to the particular direction, the developer roller being configured to carry the developing agent;

a supply roller supported to the first side wall and the second side wall and rotatable about a rotation axis extending in the axial direction, the supply roller being configured to supply the developing agent onto the developer roller;

a cap configured to seal the toner fill-hole, the cap having:

a main body part closing the toner fill-hole; and a boss extending outward from the main body part in the axial direction, the boss including an end in the axial direction;

an electrode made from electrically conductive resin and configured to supply a bias voltage to at least one of the developer roller and the supply roller, the electrode being overlapped with the cap as viewed in the axial direction, the electrode having:

a first end part contacting with the at least one of the developing roller and the supply roller;

a second end part including a contact point; and an extending part extending from the first end part to the second end part, the extending part including a fitting hole into which the boss is fitted; and a screw configured to fix the electrode to the cap by being threaded into the end of the boss in a state where the boss is fitted into the fitting hole, wherein the screw has a shaft portion threadingly engaged with the cap.

2. The developer cartridge according to claim 1, wherein the cap has an electrode mounting portion, and wherein the electrode has a fixed part fixed to and in contact with the electrode mounting portion by the screw, and has a contact part configured to be in contact with the cap at a portion other than the electrode mounting portion.

3. The developer cartridge according to claim 1, wherein the boss has an elliptical cross-sectional shape taken along a plane perpendicular to a direction of insertion of the screw into the boss.

4. The developer cartridge according to claim 1, wherein the cap has an engaging part, and wherein the first side wall has a predetermined portion, the engaging part being configured to be engaged with the predetermined portion in a state where the boss is in a predetermined orientation.

5. The developer cartridge according to claim 1, wherein the first side wall has an attachment portion at a position around the toner fill-hole to allow the cap to be attached to the attachment portion, the attachment portion having an endmost surface and a stepped surface recessed inwardly from the endmost surface in the axial direction, and wherein the cap has a circumferential part in abutment with the stepped surface.

6. A developer cartridge comprising:

a case having a first side wall formed with a toner fill-hole and a second side wall facing the first side wall in a particular direction, the case being configured to accommodate a developing agent therein;

a developer roller supported to the first side wall and the second side wall and rotatable about a rotation axis extending in an axial direction parallel to the particular direction, the developer roller being configured to carry the developing agent;

a supply roller supported to the first side wall and the second side wall and rotatable about a rotation axis extending in the axial direction, the supply roller being configured to supply the developing agent onto the developer roller;

a cap configured to seal the toner fill-hole, the cap having:

a main body part closing the toner fill-hole; and a boss extending outward from the main body part in the axial direction, the boss including an end in the axial direction;

an electrode configured to supply a bias voltage to at least one of the developer roller and the supply roller, the electrode being overlapped with the cap as viewed in the axial direction, the electrode having:

a first end part contacting with the at least one of the developing roller and the supply roller;

a second end part including a contact point; and an extending part extending from the first end part to the second end part, the extending part including a fitting hole into which the boss is fitted; and a screw configured to fix the electrode to the cap by being threaded into the end of the boss in a state where the boss is fitted into the fitting hole, wherein the first side wall of the case has an attachment portion at a position around the toner fill-hole to allow the cap to be attached to the attachment portion, the attachment portion having an endmost surface and a stepped surface recessed inwardly from the endmost surface in the axial direction, and wherein the cap has a circumferential part in abutment with the stepped surface.

7. The developer cartridge according to claim 6, wherein the cap has an electrode mounting portion, and wherein the electrode has a fixed part fixed to and in contact with the electrode mounting portion by the screw, and has a contact part configured to be in contact with the cap at a portion other than the electrode mounting portion.

8. The developer cartridge according to claim 6, wherein the boss has an elliptical cross-sectional shape taken along a plane perpendicular to a direction of insertion of the screw into the boss.

9. The developer cartridge according to claim 6, wherein the cap has an engaging part, and wherein the first side wall has a predetermined portion, the engaging part being configured to be engaged with the predetermined portion in a state where the boss is in a predetermined orientation.

* * * * *